US007703537B2

(12) United States Patent
Astleford

(10) Patent No.: US 7,703,537 B2
(45) Date of Patent: Apr. 27, 2010

(54) RECOVERY OF HYDROCARBONS

(76) Inventor: John Astleford, Ye Olde Manor House, 8 Newark Road, Bassingham, Lincoln (GB) LN5 9HA ( * ) Notice: Subject to any disclaimer, the term of this patent is extended or adjusted under 35 U.S.C. 154(b) by 0 days.

(21) Appl. No.: 12/243,305

(22) Filed: Oct. 1, 2008

(65) Prior Publication Data

US 2009/0084548 A1 Apr. 2, 2009

(30) Foreign Application Priority Data

Oct. 1, 2007 (GB) ..... 0719093.7

(51) Int. Cl.
*E21B 43/40* (2006.01)
*E21B 43/16* (2006.01)

(52) U.S. Cl. ..... 166/372; 166/263; 166/267

(58) Field of Classification Search ..... None
See application file for complete search history.

(56) References Cited

U.S. PATENT DOCUMENTS 4,693,321 A * 9/1987 Royer ..... 137/13
2009/0288938 A1* 11/2009 Rodriguez et al. ..... 201/25

* cited by examiner

*Primary Examiner*—Zakiya W. Bates
(74) *Attorney, Agent, or Firm*—Jason A. Bernstein; Barnes & Thornburg LLP

(57) ABSTRACT

A method of bringing hydrocarbons from a well into production by introducing encapsulated bubbles into the fluid in the production string to reduce the hydrostatic pressure holding the hydrocarbons in the reservoir. For reservoirs where the reservoir pressure has been depleted to the point where the reservoir pressure is not sufficient to push a column of hydrocarbons to the surface at an acceptable rate, encapsulated bubbles can be continuously introduced into the production string at a suitable depth to reduce the pressure required to bring hydrocarbons to the surface and allowing the encapsulated bubbles to be recovered and recycled.

16 Claims, 1 Drawing Sheet

RECOVERY OF HYDROCARBONS

PRIORITY CLAIM

This patent application claims priority to United Kingdom Patent Application No. 0719093.7, filed Oct. 1, 2007, the disclosure of which is incorporated herein by reference in its entirety.

FIELD

The present disclosure relates to improving production rates of hydrocarbon wells either initially or later on in the life of the reservoir.

BACKGROUND

Hydrocarbon reservoirs are pressurized due to the weight of rock and/or interstitial fluid in the formations above the reservoir. When drilling for hydrocarbons, such as oil or condensates, a column of fluid of sufficient density is used to balance or exceed the reservoir pressure to prevent the uncontrolled release of hydrocarbons to the atmosphere. However, when suitable equipment has been installed in the well and on the surface of a well to test or produce the hydrocarbons, it is desirous to bring the well into production. This is achieved by reducing the density and hence the hydrostatic pressure of fluid holding the hydrocarbons in place such that the reservoir pressure exceeds that of the column of fluid above it and hydrocarbons flow from the reservoir to the surface. Typically, when production is due to take place, a specialized tube and equipment is placed in the well bore through which the hydrocarbons flow and which, for purposes of the present disclosure, is referred to as the "production string."

The operation of bringing production online can be made more difficult by one or more of the following problems:

- Reservoir pressures decrease with time when under production;
- Formation water can be produced that may increase the density of the fluid in the production string sufficiently to stop a well flowing; and
- Brines used in the drilling process may try to flow back up the production string and increase the pressure holding the hydrocarbons in place.

There are several known methods for initiating well production or increasing production.

A gas can be injected into the production string at depth to mix with the oil and thereby reduce the resultant density of the fluid. Nitrogen, carbon dioxide and hydrocarbon gases have all been used. The disadvantage of this method is that it requires trained people, a supply of the gases, and a significant amount of complicated equipment.

Another method is to introduce electric or mechanical pumps into the wellbore to pump the oil to the surface. The disadvantage of this method is again cost, and the longevity of pumps operating deep in the wellbore is not high.

A further method is to inject water or gas into the reservoir at a different point to increase the pressure in the reservoir. The downside of this method is that separate wellbores have to be drilled and injection equipment must be installed at great cost.

SUMMARY

The present disclosure describes several exemplary embodiments of the present invention.

One aspect of the present disclosure provides a method of crude oil production from a well, comprising pumping a mixture of crude oil and encapsulated bubbles into the production string so as to reduce the back pressure on the reservoir such that the production of crude oil from the well can be initiated or increased.

Another aspect of the present disclosure provides a method of crude oil production from a well, the well having a production string connecting a hydrocarbon reservoir to a well head, the method comprising: introducing a fluid into the production string to reduce the hydrostatic pressure of the column of liquid in the production string, wherein the fluid introduced into the string is a mixture of encapsulated bubbles in crude oil.

For purposes of the present disclosure, the term "encapsulated bubble" means a hollow body filled with air or other gas so as to have a specific gravity less than 1, and preferably less than 0.5. The body may conveniently be formed of a glass, a ceramic, or a plastics material.

The percentage of encapsulated bubbles mixed into the crude oil and injected into the production string can be varied to reduce the back pressure holding the hydrocarbons in place to optimize production.

The encapsulated bubbles can be pumped down the annulus between the wellbore and the production string to get to the point of injection into the production string. Alternatively, a separate pipe can be run to the injection point in the production string.

The density of the oil mixture containing the bubbles injected into the production string can be reduced down to 0.4 SG. However, in practice these fluids are very thick so fluid densities in the region of 0.5-0.6 SG are preferred. This density can be further reduced by heating this fluid at surface before injection takes place.

The size of the encapsulated bubbles should be kept as low as is practically possible to enable the fluid to be easily pumped and the encapsulated bubbles not destroyed by the pumping process. Typically encapsulated bubbles used will be smaller than 200 microns, however, oversized bubbles could be allowed and would not be detrimental to the resultant fluid.

Ideally the compressive strength of the encapsulated bubbles should be such that when the bubbles are at the bottom of the production string and subject to the maximum pressure the bubbles do not collapse. Typically the encapsulated bubbles should be capable of withstanding pressures in the region of 10,000 kilopascals. However, for many applications values significantly lower than 10,000 kilopascals will be acceptable.

The percentage of encapsulated bubbles can be varied to achieve the desired density. Typically fluids can be mixed with up to 60% by volume of encapsulated bubbles. The limiting factor is only the ability to pump the fluid.

The major benefits of this technique are that density reductions can be achieved relatively cheaply and easily.

DETAILED DESCRIPTION

Figure 1:
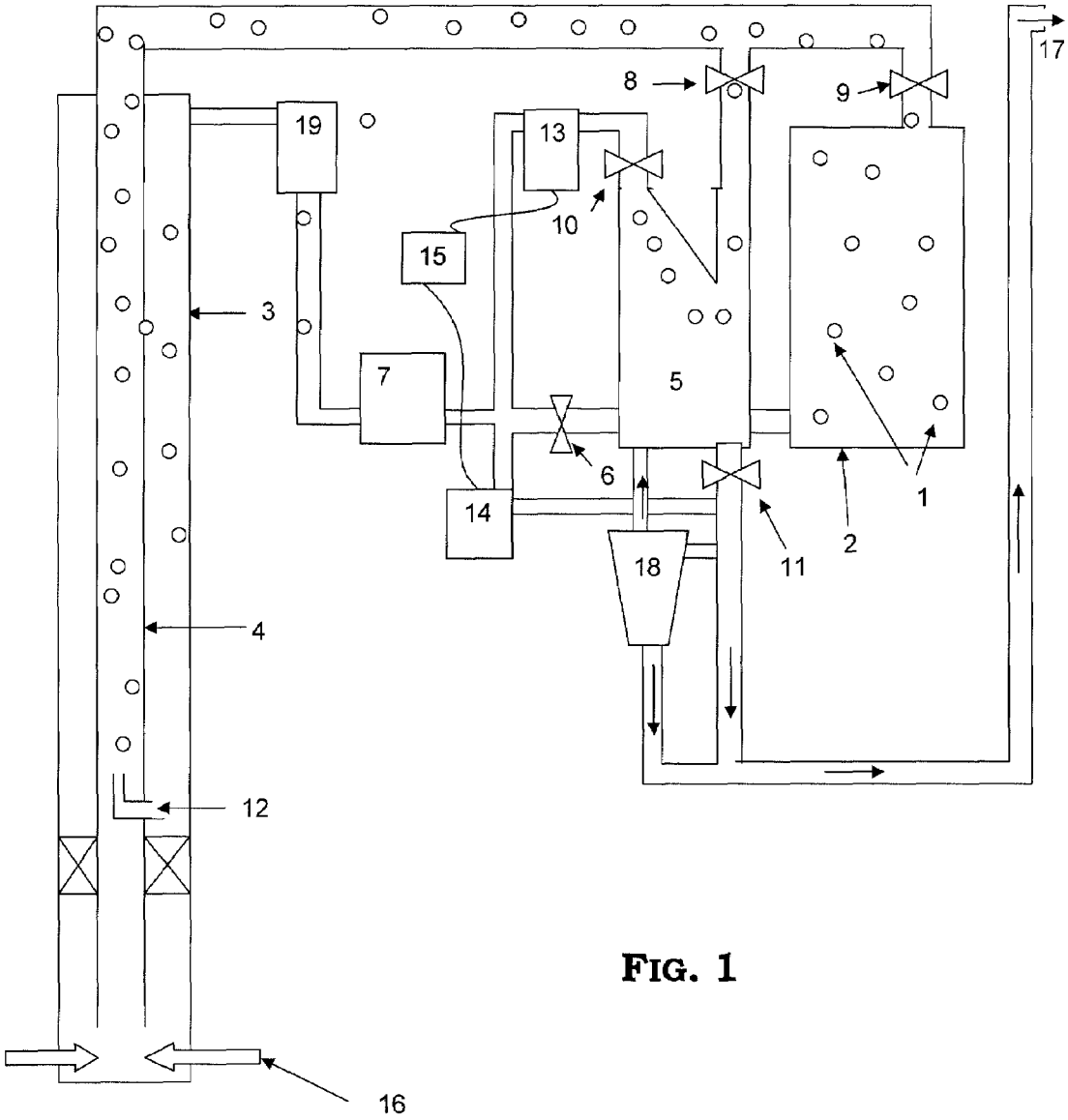
FIG. 1 is a schematic diagram illustrating an exemplary embodiment of the present disclosure in which the method is applied to an oil well in which the reservoir pressure is insufficient to push a column of its own fluid to the surface.

Encapsulated bubbles 1 are mixed with produced oil into a predesigned slurry in a holding tank 2. The volume of slurry in the holding tank 2 is equal to at least the volume of fluid in the wellbore 3, production string 4 and surface flotation tank 5 (hereafter referred to as the circulating system). To initiate the process, valves 6, 8 and 11 are opened and the fluid from the holding tank 2 is pumped via pump 7 into the circulating system until the circulating system is full of the crude bubble rich fluid, then valve 6 is closed and valve 10 is opened. All bubble slurries kept in the holding tank 2 must be continuously circulated via a separate mixing line from top to bottom to prevent the bubbles floating to the surface and forming a crust on the surface of the tank that may be hard to disperse.

As production commences, the fluid from the top of the flotation tank 5 is pumped down the wellbore 3 via pump 7 into the production string 4 via a non-return valve and venturi inlet 12. The concentration of bubbles in the injected slurry cannot be allowed to exceed predetermined levels defined by the optimum viscosity of the bubble oil slurry (typically a bubble crude slurry with a viscosity in the region of 20,000 centipoise). In the circulating system, this is achieved by having an inline densitometer 13 that controls a variable speed pump 14 via a logic board 15 that pumps crude oil containing minimal amounts of bubbles into the injection stream to ensure excessive bubble loadings do not occur.

The encapsulated bubbles reduce the back pressure on the reservoir thus improving the rate crude oil 16 flows to the surface along with the injected slurry. At the surface the resultant mixture flows into a flotation tank 5 where the encapsulated bubbles float to the upper part of the chamber and from there the bubble rich crude slurry feeds the injection pump 7. The produced crude oil is removed from the flotation chamber via production line 17. If necessary any bubbles not removed by the flotation chamber may be removed for reuse by passing the produced fluid through a bank of hydrocyclones 18. If further reductions in density and or viscosity are required to improve production rates, this can be achieved by heating the injected fluid in a heater 19. If, for any reason, it becomes necessary to stop production, it is necessary to pump bubble free crude from a separate tank (not shown) and displace the fluid in the circulating system back to tank 2 by opening valve 9 and closing valve 8. This is to prevent bubbles from floating to upper surfaces in the circulating system and packing off the flow paths.

What is claimed is:

1. A method of crude oil production from a well comprising a production string connecting a hydrocarbon reservoir to a well head, the method comprising:

a. pumping a mixture of crude oil and encapsulated bubbles into the production string so as to reduce the back pressure on the reservoir such that the production of crude oil from the well can be initiated or increased; and b. separating the encapsulated bubbles in a substantially unchanged state from the oil at the well head.

2. The method of claim 1, where the encapsulated bubbles have an average size of less than or equal to 200 microns.

3. The method of claim 1, wherein the encapsulated bubbles have a compressive strength greater than or equal to about 10,000 kilopascals.

4. The method of claim 1, wherein the encapsulated bubbles are hollow bodies of a material selected from the group consisting of glass and plastics.

5. The method of claim 1, wherein the fluid containing bubbles is injected into the production string via a venturi, so as to further reduce the backpressure on the reservoir.

6. The method of claim 1, wherein the fluid containing bubbles is heated prior to injection, thereby reducing viscosity and further reducing density.

7. The method of claim 1, wherein the fluid pumped into the production string includes a crude oil bubble rich mixture recovered by flotation from the returning crude oil.

8. The method of claim 1, further comprising separating the encapsulated bubbles from the returning crude oil for re-use by means of at least one hydrocyclone.

9. A method of crude oil production from a well, the well comprising a production string connecting a hydrocarbon reservoir to a well head, the method comprising:

a. introducing a fluid into the production string to reduce the hydrostatic pressure of the column of liquid in the production string, wherein the fluid introduced into the string is a mixture of encapsulated bubbles in crude oil; and b. separating the encapsulated bubbles in a substantially unchanged state from the oil at the well head.

10. The method of claim 9, where the encapsulated bubbles have an average size of less than or equal to about 200 microns.

11. The method of claim 9, where the encapsulated bubbles have a compressive strength greater than or equal to 10,000 kilopascals.

12. The method of claim 9, wherein the encapsulated bubbles are hollow bodies of a material selected from the group consisting of glass and plastics.

13. The method of claim 9, wherein the fluid containing bubbles is injected into the production string via a venturi so as to further reduce the backpressure on the reservoir.

14. The method of claim 9, wherein the fluid containing bubbles is heated prior to injection, so as to reduce viscosity and further reduce density.

15. The method of claim 9, wherein the fluid pumped into the production string includes a crude oil bubble rich mixture recovered by flotation from the returning crude oil.

16. The method of claim 9, further comprising separating the encapsulated bubbles from the returning crude oil for re-use by means of at least one hydrocyclone.

* * * * *